United States Patent [19]

Akimoto et al.

[11] Patent Number: 4,770,630

[45] Date of Patent: Sep. 13, 1988

[54] HEAT TREATMENT APPARATUS

[75] Inventors: Tatsuo Akimoto; Masafumi Ogasawara, both of Otsu, Japan

[73] Assignee: Toray Industries, Inc., Tokyo, Japan

[21] Appl. No.: 87,887

[22] Filed: Aug. 21, 1987

[30] Foreign Application Priority Data

Aug. 23, 1986 [JP] Japan ..... 61-197677

[51] Int. Cl.[4] ..... F27B 9/00; F27B 5/04

[52] U.S. Cl. ..... 432/121; 432/205; 432/209; 432/199; 432/202

[58] Field of Search ..... 432/205, 209, 159, 175, 432/199, 202, 121

[56] References Cited

U.S. PATENT DOCUMENTS

| | | | |
|---|---|---|---|
| 3,565,410 | 9/1968 | Scherff | 432/205 |
| 3,850,574 | 11/1974 | Namba | 432/205 |
| 4,326,694 | 4/1982 | Bergman | 432/205 |
| 4,354,827 | 10/1982 | Kissel | 432/209 |
| 4,512,737 | 4/1985 | Pierce | 432/205 |

*Primary Examiner*—Henry C. Yuen

*Attorney, Agent, or Firm*—Birch, Stewart, Kolasch & Birch

[57] ABSTRACT

A heat treatment apparatus which comprises a treatment chamber formed with heat insulating walls, a graphite heater installed in the treatment chamber, a gas supply port supplying non-oxidizing gas to the chamber and an exhaust port for carrying gas out of the chamber. At least a part of the inner side of the heat insulating walls is made of graphite group material of bulk density of not less than 0.3 g/cm$^3$. The ratio of the outer surface area of the graphite heater (Ah) to the surface area of the chamber-facing side of the heat insulating walls (Ai), Ah/Ai is within the range of 0.1–0.4, and the relationship between the surface area of the graphite group material (Ar) and (Ah) is Ar>Ah. By this structure, the temperature of the heater to be set for heat treatment of workpieces can be decreased, and the life spans of the heater and the heat insulating walls can be increased.

17 Claims, 7 Drawing Sheets

HEAT TREATMENT APPARATUS

BACKGROUND OF THE INVENTION

1. Field of the Invention

The present invention relates to an improved heat treatment apparatus and more specifically to an apparatus for producing a C/C composite, i.e., a carbon/carbon composite material, graphite, etc. used as an electrode base material for fuel cells, etc. by applying heat treatment to the workpieces to be treated under a non-oxidizing atmosphere of more than 2000° C., preferably more than 2500° C.

2. Description of the Prior Art

According to conventional methods, the electrode base materials of fuel cells are produced, for example, by solidifying carbon fibers into a sheet-like shape, using a binding resin, such as a phenolic resin, and then calcining the workpiece in a highly purified non-oxidizing atmosphere at a temperature between about 1000°-3000° C.

Because of the purpose for which this kind of electrode is used, the electrode requires characteristics, such as oxidization resistivity, chemical resistivity, electrical corrosion resistivity as well as conductivity and gas permeability, etc., and these characteristics are heightened as the above calcining temperature is increased. For example, the desirable calcining temperature for electrode materials for phosphoric acid type fuel cells is said to be above 2200° C., preferably more than 2500° C.

Conventional industrial furnaces for such high temperature heat treatment call for methods, such as induction heating, Tammann heating, Acheson heating, resistance heating, etc.

In the induction heating and Tammann heating methods, graphite materials are often used as the heating element under a non-oxidizing atmosphere of 2000°-2500° C. or above, as shown in JP-B-No. 59-7803, JP-B-No. 59-25936, etc. The heating elements used for these heating methods are generally tube-like in shape, with the inside spaces of these tubes serving as an effective heating area. For this reason, due to the limitation in the size of the graphite to be used as the heating element, the size of workpieces to be calcined is limited. For instance, it is difficult, using conventional methods, to calcine large square electrode materials of more than 1 m×1 m in width and length for fuel cells for practical use.

On the other hand, the Acheson heating method, which is a heating method generally used for calcining graphite materials, calls for heating graphite powder by directly applying current to it, thus applying heat treatment to workpieces buried in the graphite powder. However, as the result of an experiment in which several hundreds of electrode materials of 1 m in width, 1 m in length and 0.1 mm in thickness each were stacked with graphite material loaded on them, and placed in a graphite box, and in which the calcining treatment according to the Acheson heat treatment method was applied to them, it has been found that the yield is quite bad as the materials stick to each other and wrinkles form on the surface of the materials. Possible reasons for such results include separation of impurities from graphite powder and the adhesion of these impurities to the base materials and uneven generation of heat to the base materials, etc. Further, this method has another disadvantage in that due to the large thermal capacity of graphite powder, it takes quite a long time, for instance 1-3 weeks, for heating or cooling.

According to the resistance heating method, a highly purified atmosphere can be obtained if a heat resistant material which contains no impurities nor reacts with the atmospheric gas is used as the insulating material, and the uniformity and gradient of the temperature can be set at any desirable condition, by arranging the heating elements at suitable locations facing the workpieces, because the heating elements are completely separate from the workpieces to be heated, and the workpieces are heated, not by means of generation of heat in themselves, but by radiating heat from the heating elements completely separate from the workpieces. Therefore, this method is widely used.

However, in cases where workpieces in the shape of a wide sheet or block are calcined by high temperature, especially more than 2500° C. in a non-oxidizing atmosphere, the heat resistance method will present problems as described below, because the furnaces of the heat resistance method usually use graphite group heat insulating materials. Since the graphite group heat insulating materials do not have so much thermal capacity, due to their small bulk density, and they greatly absorb the heat radiated from the heater and greatly release the heat to the outside because their emissivity is about 1, it is necessary to set the heater temperature much higher than the treatment temperature for the workpieces. Therefore, in order to obtain high treatment temperature, especially of higher than 2500° C., by the resistance heating method using a graphite heater, the temperature of the heater often has to be increased to the high vaporization rate temperature of the graphite. Vaporization of graphite reduces the life span of the heater; for example, when the treatment temperature is 2500° C., the life span of the heater is reduced to between several tens and several hundreds of hours, several months at the longest.

In the case of treating workpieces where a binding resin is used, such as the electrode base materials of fuel cells, substances generated from thermal decomposition of the binding resin at the time of treatment must be taken out of the treatment chamber. If the resin is a phenolic resin, this substance consists of combustible matter, such as cresol, xylenol, hydrocarbon, carbon monoxide, etc., which, at room temperture, are in various modes ranging from the gaseous phase to the liquid phase. As for the heat insulating material, it is the general practice to use a graphite group insulating material, such as graphite felt, at least at the innermost side of a treatment chamber when the treatment temperature is 2500° C. or higher. However, such practice presents some disadvantages including, shortened life span due to vaporization of heat insulating material and decrease of heat insulating capacity caused by the thermal decomposition of matter, which is generated from the workpieces to be treated and solidifies in the low-temperature part of and adheres to the graphite felt.

Further, for this kind of heat treatment, inert gases, such as $N_2$, Ar, He, etc., are used as the non-oxidizing atmosphere. In case $N_2$ is used, however, there is a problem that the heater and heat insulating material made of graphite material will deteriorate considerably, because $N_2$ and graphite react together at high temperatures of more than about 2500° C. And when Ar is used, it is generally known that electric gas discharge (dielectric breakdown) is generated at high temperatures.

Furthermore, in applying heat treatment in a non-oxidizing atmosphere to workpieces which will generate a large amount of inflammable matter, conventional apparatuses will present problems as described below:

(a) As there is no means of separating a non-oxidizing atmospheric area which contains combustible gas generated (hereinafter referred as combustible gas atmospheric area) from an oxidizing atmospheric area in the exhaust gas treatment department, there is a possibility that the pressure relativity between the two atmospheric areas may be reversed and the oxidizing gas will counterflow into the combustible gas atmospheric area due to various complications, such as operation conditions, operation error, malfunction or other accidents, thus causing generation of a mixed atmosphere exceeding the explosion limit or damage to the products by the oxidizing gas.

(b) As conventional apparatus are not structured to cope with changes in the amount of gas generated through thermal decomposition and sudden changes in gas volume due to heat expansion resulting from changes in the treatment temperature, it is difficult to keep the treatment pressure within a specified range. There is a fear that gas pressure may exceed the pressure resistance capacity of the treatment chamber, depending on treatment conditions.

(c) Conventional apparatus are so designed that when increasing or decreasing treatment temperature or when stopping the apparatus, exhaust gas always passes through the exhaust gas incineration equipment, even though the density of the gas generated through thermal decomposition has become lower than the environmental safety standard level. In order to prevent this low density thermal decomposition matter from condensing in the cool part of the passage in the exhaust gas system and from adhering to and accumulating in the system, it is necessary to continuously operate the exhaust gas incineration equipment in spite of the fact that the density of the gas generated through thermal decomposition is low enough, and thus energy efficiency is bad.

SUMMARY OF THE INVENTION

An object of the present invention is to provide a heat treatment apparatus which can allow heaters and heat insulating materials used for the apparatus to maintain a long life span and can maintain the heat insulating capacity of the heat insulating materials for a long period of time, when it is used for calcining workpieces in the shape of a wide sheet or a block at high temperatures, more specifically temperatures of about 2500° C. or more.

Another object of the present invention is to provide a heat treatment apparatus for treating workpieces of large width containing thermal decomposition substances, such as c/c composite used for electrode base materials of fuel cells, safely, with good operational productivity and high energy efficiency.

To accomplish the above objects, a heat treatment apparatus according to the present invention comprises a treatment chamber for applying heat treatment to workpieces in a non-oxidizing atmosphere; a graphite heater installed in the treatment chamber; an atmosphere gas supply port to supply gas in order to provide the non-oxidizing atmosphere in the treatment chamber; and an exhaust port to carry gas out of the treatment chamber. The treatment chamber is formed with heat insulating walls made of a heat insulating material, and at least a part of the inner side of the heat insulating walls is made of a graphite group material of 0.3 g/cm$^3$ or more of bulk density. The ratio of the outer surface area of the graphite heater (Ah) to the surface area of the chamber-facing side of the heat insulating walls (Ai), i.e. Ah/Ai, shall be within the range of 0.1–0.4, and the relationship between the surface area of heat insulating wall which comprises a graphite group material of not less than 0.3 g/cm$^3$ of bulk density (Ar) and the outer surface area of the graphite heaters (Ah) shall be Ar>Ah.

The treatment chamber is formed in a vessel-like structure which makes up a furnace. The shape and material of this vessel-like structure are not necessarily specified, so metal, for example, may be used.

Heat insulating walls according to the present invention may consist of any single or combination of many different kinds of or layers of such single or different kinds of material; such as graphite group heat insulating materials, which will be mentioned below, graphite, or other heat insulating or heat resistance materials generally known. The heat insulating walls do not have to be of a specified structure but, preferably have a thickness of approximately 50–300 mm.

Concerning the graphite group heat insulating materials, graphite felt, rigid graphite felt, carbon wool, graphite powder, graphite granules, porous carbon, may be used and among them rigid graphite felt is the most desirable. Heat insulating material made of rigid graphite felt is easy to assemble or replace because of the ability of rigid graphite felt to maintain its form.

According to the present invention, the ratio of the outer surface area of the graphite heater of the heat treatment apparatus (Ah) to the surface area of the inner side of the heat insulating walls (Ai), Ah/Ai, must be within the range of 0.1–0.4, and at least a part of the side of the heat insulating walls facing the treatment chamber must be made of a graphite group material of not less than 0.3 g/cm$^3$ of bulk density. The relationship between the area of the surface of the wall made of the graphite group material of not less than 0.3 g/cm$^3$ of bulk density (Ar) and the outer surface of the heater (Ah) must be Ar>Ah. If Ah/Ai is less than 0.1, the load on the heater will exceed the normal level, and thus abnormal heat generation is likely to occur in some local parts of the heater. On the other hand, in cases where Ah/Ai is more than 0.4, quite a large amount of current will be needed due to the resistance of the heater being too low, so a power source of large capacity will be required, and the thermal capacity of the heater will also become too large. When the heat insulating material on the side of the heat insulating wall facing the treatment chamber has a bulk density of 0.3 g/cm$^3$ or more, it functions as if it were a kind of heater by reflecting the radiation heat from the heater to it. By keeping the relationship of Ar>Ah, the above function can be sufficiently ensured. Therefore, the temperature of the heater necessary to maintain a specified temperature for the workpieces can be set lower and the temperature distribution will also be improved. Moreover, since the temperature of the heat insulating material having a bulk density of not less than 0.3 g/cm$^3$ does not become too high on account of the high ability of reflecting the radiation heat from the heater, and since the invasion of thermal decomposition gas into the heat insulating material can be prevented on account of the high bulk density of the material, the deterioration and damage of the material also can be suppressed. With the configuration described above, the life spans of the graphite heater and the heat insulating material will be considerably extended, especially when the treatment temperature is as high as 2500° C. or more.

The above described graphite group materials having a bulk density of not less than 0.3 g/cm$^3$, which may be used for the present invention include:

(1) graphite foil,
(2) glassy carbon, and
(3) graphite coating material.

Among the above graphite group materials, those which have emissivity of not more than 0.8 at 2000° C. are more preferable because of the reflection of radiation heat. The outer surface area of the graphite heater (Ah) referred to hereinabove means the total outer surface area of only that part which will positively generate heat. Namely, out of the graphite materials to which electric current is applied, excluded are the electrode parts which induct current to the heat generating parts and the center part of the three-phase Y connection, connecting parts of the heater terminals, supporting parts, etc. Also, in case the heater is constructed from a hollow material, Ah corresponds to the outer surface area only.

The inner surface area of the heat insulating walls (Ai) means the total surface area of the inner sides of the heat insulating walls which form the treatment chamber, and areas of the temperature measuring ports, electrode inlet ports, etc. are excluded from the calculation. The surface area of an irregular surface is calculated, as a rule, as the total area of planes of projection projecting in the direction vertical to the irregular surface. As for the heat insulating walls comprising layers of mateials, Ai is calculated as the total area of planes of projection of the most inner side.

The area of the surface of the wall made of the graphite group material (Ar) means the total area of planes of projection of the material projected to the inner sides of the heat insulating walls which form the treatment chamber. Even when there are overlapped portions where the graphite group materials overlap with each other or when a plurality of the graphite group materials are stacked in the direction of wall thickness, only one plane of projection corresponding to the overlapped portions or the stacked portions is calculated for (Ar).

In a heat treatment apparatus according to the present invention, a treatment chamber is structured basically as a closed space. The closed space is formed partly or almost entirely with the graphite group material forming the chamber-facing side of the heat insulating walls. It is, of course, possible to use a combination of the aforementioned materials to structure the chamber. It is also possible to make all of the heat insulating walls with the graphite group materials, although it is not advisable because it will make the cost too high and cause the heat insulating efficiency to deteriorate.

Graphite foil is a sheet-like, flexible graphite produced by the acid treatment of graphite to form interlaminar compounds and after the thermal decomposition and expansion treatment, compressing or calender-molding the compound. As graphite foil is produced by being pressed after treatment by heat decomposition and expansion, its bulk density is approximately 0.3–1.8 g/cm$^3$ while that of the heat insulating sheet material of the ordinary graphite group is approximately 0.02–0.29 g/cm$^3$. Graphite powder and graphite granules can be used as heat insulating materials of the graphite group, with a bulk density of approximately 0.08–1.0 g/cm$^3$, but they cannot be used independently because of their lack of ability to maintain their forms.

When using graphite foil, it is recommended to use one whose emissivity is as low as possible, not more than 0.7, at 2000° C., but the lowest possible figure for the emissivity is about 0.4 at the same temperature. The thickness of graphite foil is usually about 0.1–2 mm, but lamination can make it thicker.

Glassy carbon is a non-crystalline graphite with characteristics of both glass and carbon and is produced by forming thermosetting resins which are difficult to graphitize, such as a furan resin, a phenolic resin, etc. into a specified shape by means of extrusion molding or other means and then, after thermo-curing the shaped material while applying pressure, carbonizing it by slowly increasing the temperature to about 2000°–3000° C. Glassy carbon normally has a bulk density of 1.2–1.6 g/cm$^3$ and those in shapes of a plate, rod, pipe, etc. are available. Maximum thickness available for the plate-like glassy carbon is about 3 mm.

Graphite coating material is formed as follows. Carbon black or fine-grain graphite is fused by an appropriate binding resin to a paste, and the paste is heat-cured after it is onto the surface of, for example, rigid graphite felt. Thus graphite coating material is formed and used. The coating material can be obtained as a carbonaceous material of more than 95%.

Among the above graphite group materials, since graphite coating material is easily eliminated by vaporization if the material is used under the condition of more than 2500° C., graphite foil or glassy carbon is preferable for use of such a condition.

Further, emissivity $\epsilon$ is defined by the following formula, which divides the emissive power of a substance other than a black body E by radiation capacity of a black body at the same temperature Eb:

$$\epsilon = E/Eb$$

Emissive power referred to herein means the amount of energy radiated per unit area of the surface of the substance in question and per unit of elapsed time.

In a heat treatment apparatus according to the present invention, it is preferred to structure the graphite group material forming the inner surface of the heat insulating wall as a curved surface of a paraboloid shape whose focal point is a graphite heater. Thus the infrared rays radiated from the heater and directed against and reflected off the surface of the heat insulating wall can be precisely directed towards the workpieces. In this case, it is furthermore preferable if the emissivity of the graphite group material be not more than 0.8 at 2000° C., as aforementioned.

The configuration of the treatment chamber according to the present invention is not necessarily specified, as long as it is essentially enclosed by heat insulating walls, but an air-tight chamber using metal structural materials is recommended in order to resist increasing and decreasing pressure inside the chamber. It is furthermore desirable to install water-cooling jackets in the structural material of the chamber to cool its inner walls. The temperature of the structural material is easily maintained lower than the fusing point.

The graphite heater disposed in the treatment chamber is a graphite heating element produced by processing ordinary graphite material and can be in any shape whether whole or in sections, including a rod, pipe, plate, etc. Although there is no specific requirement for the graphite heater, one which is isotropic and with high graphite content and low content in heavy metal, ash, etc. is preferable. In particular, when using the heater at high temperatures of more than 2500° C., for the sake of longevity of the graphite heater, it is desirable to make the treatment chamber essentially a closed space with the heat insulating walls whose chamber-facing sides are made of graphite group material with a bulk density of not less than 0.3 g/cm$^3$ as described above, and at the same time it is also desirable to make the relation of total surface area of the graphite heater Ah to the total surface area of the wall which forms the clsoed space Ai, i.e. Ah/Ai, not less than 0.1 and not more than 0.4. The current density of the heater (current value divided by section area of the heater) i is recommended to be not more than 5 (A/mm$^2$), preferably 2 (A/mm$^2$). With the above conditions met, the electrical and thermal load upon the heater can be lessened and thus the life span of the heater can be extended.

If the graphite group material of not less than 0.3 g/cm$^3$ of bulk density is closely bonded to the heat insulating material, the heat will easily dissipate out of the furnace by heat conduction. This can be easily controlled, however, by making a space between the graphite group material and the chamber-facing side of the heat insulating wall by means of a graphite spacer. In this case, although graphite foil may be used as the graphite group material, glassy carbon is more desirable because of its flexibility. This material can be fixed with graphite nuts and bolts.

The heat insulating wall may be constructed of rigid graphite felts, which are separated into plural layers in the direction of the wall thickness. In this case, it is recommended to construct the surface, not only the side facing the chamber, but the surface of all the sides, of the plural layers of rigid graphite felts with graphite group material with a bulk density of not less than 0.3 g/cm$^3$, because to do so is helpful in preventing deterioration of the felt itself and also in preventing evaporated gas of substances generated by thermal decomposition from invading the rigid graphite felt and condensing in a cool part thereof and, consequently, from causing deterioration in the efficiency of the heat insulating material.

The treatment chamber of a heat treatment apparatus according to the present invention may be in various shapes, depending on the shape of the workpieces to be treated. For plate-like workpieces, such as electrode base materials for fuel cells, a chamber in the shape of a box is preferable. A box-type chamber has three pairs of heat insulating walls, each wall of a pair facing the other. Graphite heaters can be arranged along at least one pair of walls which face each other and other pairs of walls which face each other can be constructed with the aforementioned graphite group materials. Configurations such as those above, in which graphite group materials serve as a kind of heater even on the walls where heaters are not installed, will allow the workpieces to be heated evenly. Moreover, by arranging both heaters on a pair of facing walls and the temperature control systems of the heaters in plurality, layers of wide plate-like workpeices can receive heat treatment applied evenly on both the front and back sides.

The heat treatment apparatus according to the present invention is equipped with a gas atmosphere supply port to supply non-oxidizing gas, and an exhaust port. It is desirable to so structure the inside of the treatment chamber as to allow heat treatment under a pressurized atmosphere of not less than the outside air pressure.

The atmosphere gas supply port is a hole to supply non-oxidizing gas, such as $N_2$, Ar, He, or mixed gas thereof, into the treatment chamber and it may be capable of being connected to the gas source. The exhaust port is a hole for carrying gas out of the treatment chamber.

According to the present invention, the treatment chamber is not restricted by any other condition as long as it basically forms an enclosed space. "The basically formed enclosed space" means to form a substantially enclosed space, notwithstanding the aforementioned gas supply or exhaust ports and the temperature measuring ports. The doors to take the workpieces into or out of the chamber serve as a part of the enclosed space.

A treatment chamber of a heat treatment apparatus according to the present invention is recommended to be structered in a vacuum-proof vessel and connected to a vacuum suction device, which is used for forced exhaust ventilation. The reason for the above is that, when replacing the atmosphere in the chamber with a non-oxidizing gas, it is far more efficient to fill up the chamber with a replacement gas after vacuuming out the air of the chamber, than replacing the atmosphere by merely blowing the replacement gas into an air-filled chamber. When connecting the vacuum suction device to the exhaust port via an exhaust pipe, it is recommended to install a heat resisting vacuum-proof valve in the exhaust pipe which leads the gas to the exhaust gas incineration device to be mentioned below, and in order to maintain the heat resisting capacity of the heat resisting vacuum-proof valve, it is preferred to install an exhaust gas cooling device between the heat resisting vacuum-proof valve and the exhaust port to cool the exhaust gas to below the maximum allowable temperature of the heat resisting vacuum-proof valve.

It is also recommended to install exhaust gas incineration device at the exhaust pipe at the downstream of the aforementioned heat resisting vacuum-proof valve, especially for a heat treatment apparatus that treats workpieces which produce substances generated by thermal decomposition. Conventional technology, such as the direct incineration method, the catalyst method, etc., may be used for the exhaust gas incineration device, but because oxygen is needed to burn substances generated by thermal decomposition, air is ordinarily used for the incineration. As the heat resisting vacuum-proof valve is able to strictly separate the non-oxidizing atmosphere system in the heat treatment furnace side from the oxidizing atmosphere system at the time the exhaust gas is incinerated, even if the pressure of the oxidizing atmosphere system becomes higher than that of the non-oxidizing atmosphere system, it is possible to prevent the two atmospheric systems from mixing with each other into an explosive mixed gas by closing the heat resisting vacuum-proof valve.

Furthermore, it is possible to directly vent the exhaust gas out of the system, when the gas need not be incinerated, by installing a direct exhaust valve to vent gas directly into the outside air in the middle of the exhaust pipe between the heat resisting vacuum-proof valve and the exhaust gas incineration device so that the incineration device may be prevented from becoming dirty.

It is possible to change the atmospheric gas, depending on the temperature at which the apparatus is used, by providing a plurality of gas supply pipes to the non-oxidizing atmosphere gas supply port and installing a valve in each of these pipes so that the life span of the furnace materials, including graphite heaters can be extended. Of course, the above gas supply pipes may be provided for each of the plurality of gas supply ports, or forked piping may be used for one gas supply port.

There are two methods recommended according to the present invention, for replacing gas. One calls for replacing the natural air atmosphere in the treatment chamber with $N_2$ at room temperature or while increasing the temperature and, when the temperature in the treatment chamber (the furnace temperature) reaches the range of from 1000° C. to 2500° C., replacing the atmosphere with an inert gas, such as Ar, He, etc., or mixture thereof or a mixed gas of any of those with $N_2$, and then applying heat treatment to the workpieces and finally cooling the workpieces as they are. The other calls for replacing the atmosphere again with $N_2$ when the furnace temperature has cooled down to the range of from 2500° C. to 1000° C. For these methods, it is furthermore preferable to replace the gas in the treatment chamber by the vacuum replacement method.

By the above methods, it is possible to lower the ratio of $N_2$ at high temperatures in the total atmosphere or to replace $N_2$ with other inert gases, so that the deterioration of the life span of the furnace caused by reaction between carbon or graphite furnace material and $N_2$ gas can be prevented.

It is possible to prevent heat decomposed material from condensing and thus from clogging the piping by installing heating means in the exhaust pipe between the heat resisting vacuum-proof valve and the exhaust gas incineration device to heat the exhaust gas so that its temperature will not drop below the boiling point of the substances generated by thermal decomposition. In this case, the preferred heating temperature is generally higher than about 200° C.

BRIEF DESCRIPTION OF THE DRAWINGS

The accompanying drawings, which are incorporated in and constitute a part of this specification, illustrate several embodiments of the invention and together with the description serve to explain the principles of the present invention.

DETAILED DESCRIPTION OF THE PREFERRED EMBODIMENT

Figure 1:
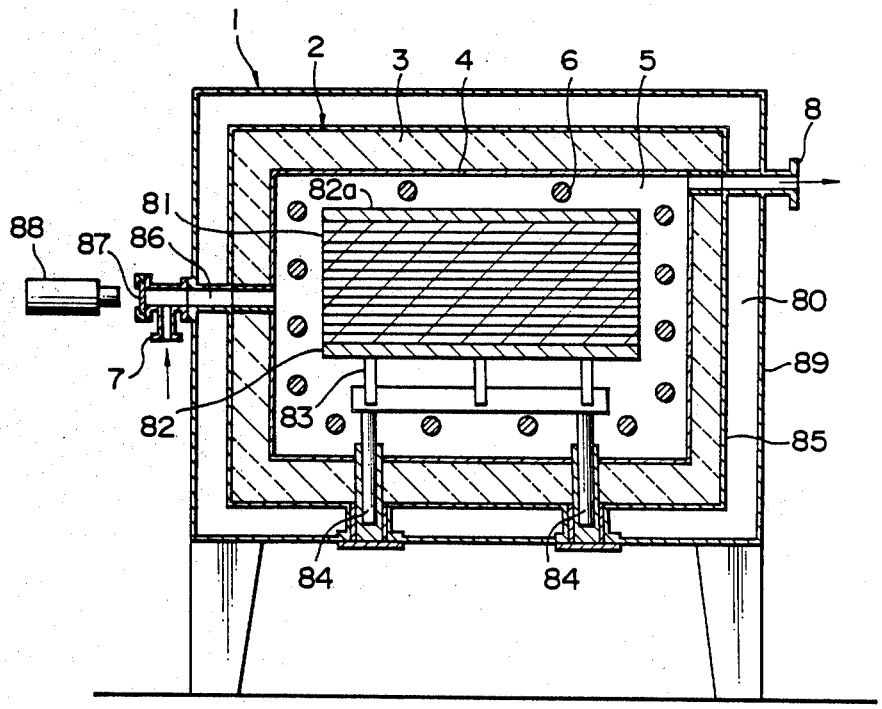
FIG. 1 is a schematic, vertical, sectional view of a heat treatment apparatus according to a first embodiment of the present invention.

The illustrated preferred embodiments of the present invention will be described hereunder referring to the attached drawings wherein like reference numerals refer to similar parts;

FIGS. 1 to 4 are schematic vertical, sectional views of each embodiment wherein a heat treatment apparatus according to the present invention is used as a calcining furnace.

In FIG. 1, a calcining furnace 1 comprises a treatment chamber 5 enclosed by heat insulating walls 2, which consist of heat insulating material 3, such as rigid graphite felt, graphite group material 4 of not less than 0.3 g/cm$^3$ of bulk density, graphite heaters 6 arranged in the treatment chamber 5, an atmosphere gas supply port 7 to supply a non-oxidizing gas and an exhaust port 8. The apparatus is so configurated that the relation of the outer surface area of the heaters 6 (Ah) to the inner surface area of the insulating walls (Ai), i.e. Ah/Ai is $0.1 \leqq Ah/Ai \leqq 0.4$. As long as the heat insulating walls 2 form an essentially enclosed space equal to the space of the chamber 5 with the graphite group material 4 of not less than 0.3 g/cm$^3$ of bulk density, for example graphite foil, arranged at least on the sides facing the chamber 5, it will fulfill the requirements for the heat insulating walls. There will be no problem if the walls are constructed with only layers of graphite foil, the heat insulating material 3 being omitted, or the walls are constructed with layers of the heat insulating material 3 and graphite foil inserted between the layers of the heat insulating material 3.

Workpieces to be treated 81, which are electrode base materials or other similar materials in the shape of sheets, are stacked on a graphite plate 82 supported by the furnace floor 83, and a graphite plate **82*a* is placed on the top of the workpieces in order to prevent heat distortion. The temperature of the workpieces 81 may be measured by means of, for example, a radiation thermometer 88 at a temperature measuring port 86 through a quartz glass window 87. The treatment chamber 5 has an atmosphere gas supply port 7, which may be located, for example, at the temperature measuring port 86. By locating the gas supply port in this position, the supplied atmospheric gas will constantly clean the inner surface of the quartz glass 87, thus preventing the quartz glass 87 from becoming dirty with substances generated by thermal decomposition and consequently preventing errors in measurement by the radiation thermometer 88. The gas supply port 7 may, of course, be located independently from the temperature measurement port 86. The treatment chamber 5 has an exhaust port 8, separate from the gas supply port 7**.

The heat insulating walls 2 are surrounded by the air-tight chamber structural material 85, and a water jacket 80 is installed between the chamber structural material and jacket walls 89.

As for the abovementioned graphite foil, those on the market may be used. Although heat conductivity of graphite foil along the vertical line to its surface is not good, it has advantageous characteristics, such as high heat conductivity parallel to its surface, extremely high chemical stability because of its high graphite crystallinity, and its emissivity being normally not more than 0.8 at 2000° C.

As shown in FIG. 1, graphite foil which has the characteristics mentioned above is attached to and covers the graphite group heat insulating material 3 by means of graphite cement, graphite bolts, or sewing with graphite fiber, etc. to construct the heat insulating walls 2, which forms the enclosed space. By this structure, it becomes possible to make the heat radiated from the graphite heaters 6 reflect, without letting most of it escape out of the system, which has been the inevitable case according to the conventional methods. With the above accomplished as well as keeping the aforementioned ratio of Ah/Ai within the range of 0.1–0.4, it is possible to make the set temperature of the heaters 6 for the treatment temperature for the workpieces 81 lower than that required by the conventional methods and also to inhibit the local, abnormal generation of heat.

Figure 2:
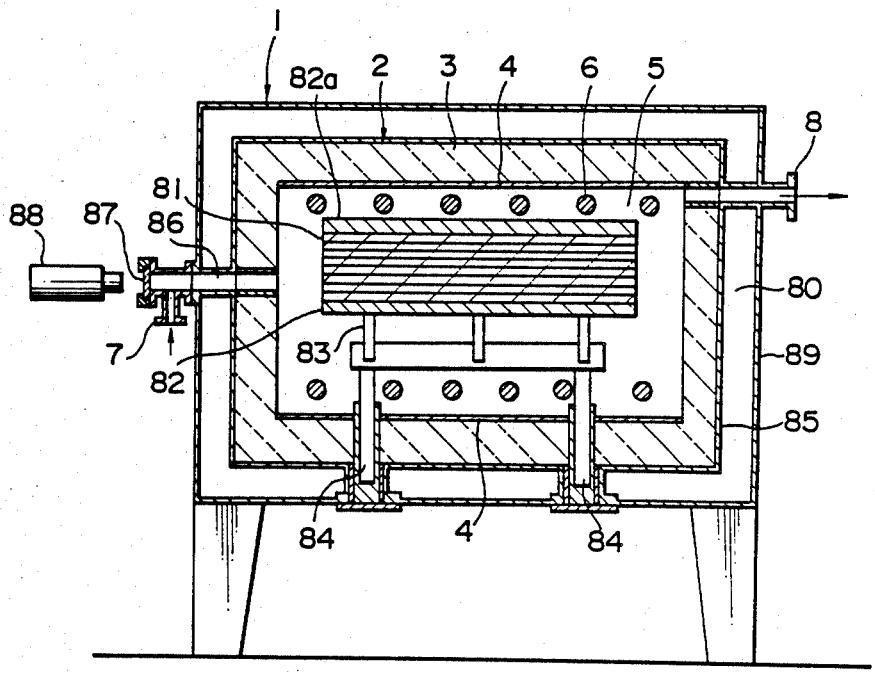
FIG. 2 is a schematic, vertical, sectional view of a heat treatment apparatus according to another emobodiment of the present invention.

FIG. 2 shows a calcining furnace of a heat treatment apparatus according to another preferred embodiment of the present invention.

In a calcining furnace 1 shown in FIG. 2, graphite heaters 6 are arranged along the pair of walls facing each other (in this embodiment the upper and lower walls) which surface area is the largest of all three pairs of walls of the treatment chamber 5, and not along the other 2 pairs of walls. The surfaces of the walls which the graphite heaters 6 are facing, i.e. the ceiling and the floor of the treatment chamber 5, consist of a graphite group material with a bulk density of not less than 0.3 $g/cm^3$. With the configuration as above, the temperature of the graphite heaters 6 can be set lower than it might otherwise be, and also the arrangement of the heaters will be easier, because radiation heat from the heaters is reflected efficiently towards the workpieces 81 by the graphite group material 4.

Figure 3:
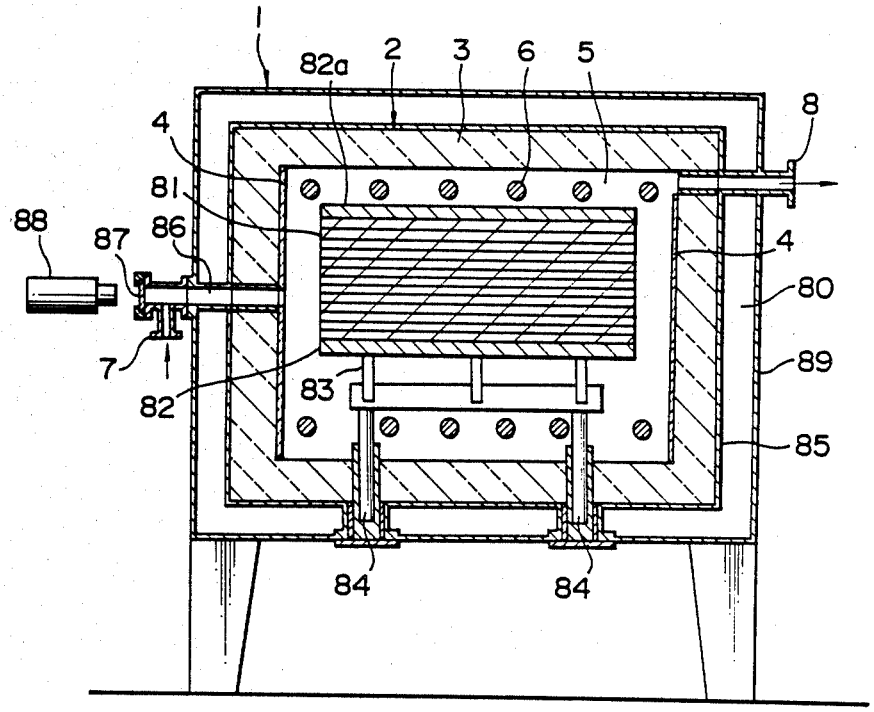
FIG. 3 is a schematic, vertical, sectional view of a heat treatment apparatus according to a further embodiment of the present invention.

FIG. 3 shows a calcining furnace according to another embodiment of the present invention. According to this embodiment, graphite heaters 6 are arranged face to face with one pair out of the plurality of pairs of the facing heat insulating walls, the surfaces of the other heat insulating walls being made of graphite group material of not less than 0.3 $g/cm^3$ of bulk density. Whether to adopt the configuration shown in FIG. 2 or the one shown in FIG. 3 may be decided upon after considering the shape of the workpieces, the ratio of the height and the horizontal size of the treatment chamber, etc.

According to the embodiments illustrated in FIGS. 1 to 3, the temperature is controlled, for example, by the method of utilizing a thermoelectric couple in the low temperature range, and in the high temperature range, by the method of utilizing a radiation thermometer 88 detecting the temperature of the workpieces 81 or the heaters 6 through the temperature measuring port 86 as shown in FIG. 1. At that time, if it is difficult, due to temperature distribution, to control the temperature of the whole treatment chamber 5 with a single control system while measuring the temperature at one point, it is recommendable to control the temperature by dividing the chamber into a plurality of areas. For instance, according to the embodiments illustrated in FIGS. 2 and 3, it is recommended to control the temperature by dividing the space of the chamber by the rows of graphite heaters 6 arranged at the top and bottom of the chamber as the control zones and detecting the temperatures at or near each row of heaters.

Figure 4:
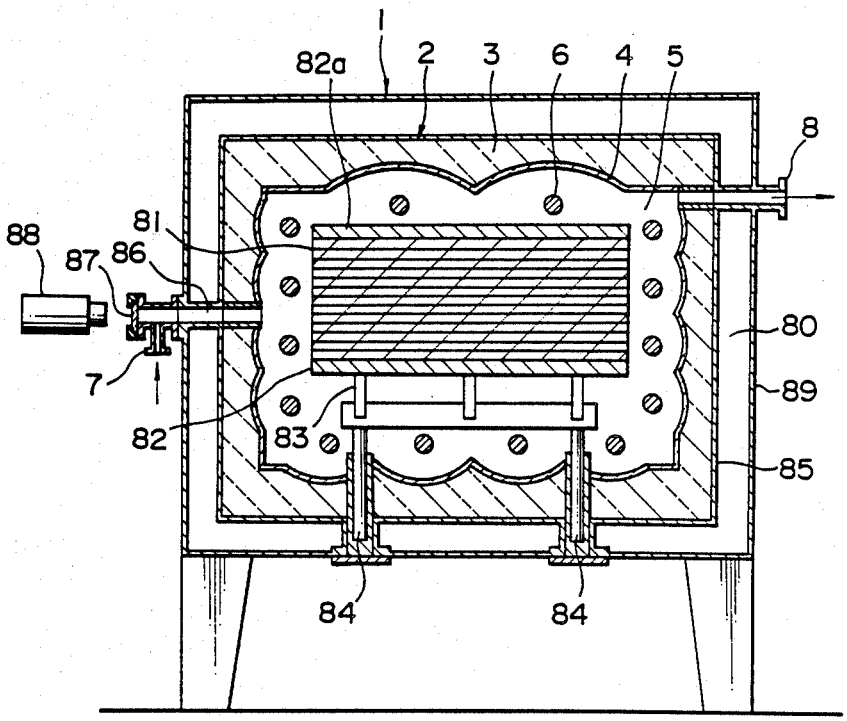
FIG. 4 is a schematic, vertical, sectional view of a heat treatment apparatus according to a further embodiment of the present invention.

FIG. 4 is a schematic vertical, sectional view to illustrate a heat treatment apparatus according to a further preferable embodiment of the present invention.

In the embodiments illustrated in FIGS. 1 to 3, the enclosed space is formed with plane graphite materials 4 of not less than 0.3 $g/cm^3$ of bulk density, but it is not certain that radiation heat from the graphite heaters 6, which is reflected by the graphite group materials 4, will be reflected precisely in the direction of the workpieces. Therefore, by arranging the graphite material 4 on a paraboloid having foci positions at graphite heaters 6, as shown in FIG. 4, it becomes possible to direct the radiation heat reflected by the graphite group material towards the workpieces 81 precisely, at a single bounce, and also to set the temperature of the heaters 6 even lower than that according to the embodiments shown in FIGS. 1 to 3. In this case, the graphite group material, used for the heat insulating walls which are at a right angle with the axial line of the graphite heaters 6, in other words, used for the surfaces, facing the chamber, of the heat insulating walls which make a right angle with the line perpendicular to the sheet showing FIG. 4, may be flat surfaces. An essentially enclosed space may be thus formed by the combination of the walls including the paraboloidal graphite group material and the flat surfaced walls. As for the graphite group material according to this embodiment, material whose emissivity at 2000° C. is not more than 0.8, for example graphite foil, is recommended for the purpose of forming the paraboloid.

In FIGS. 1 to 4 some parts of the graphite heaters 6, such as electrodes and terminals, are not shown.

Figure 5:
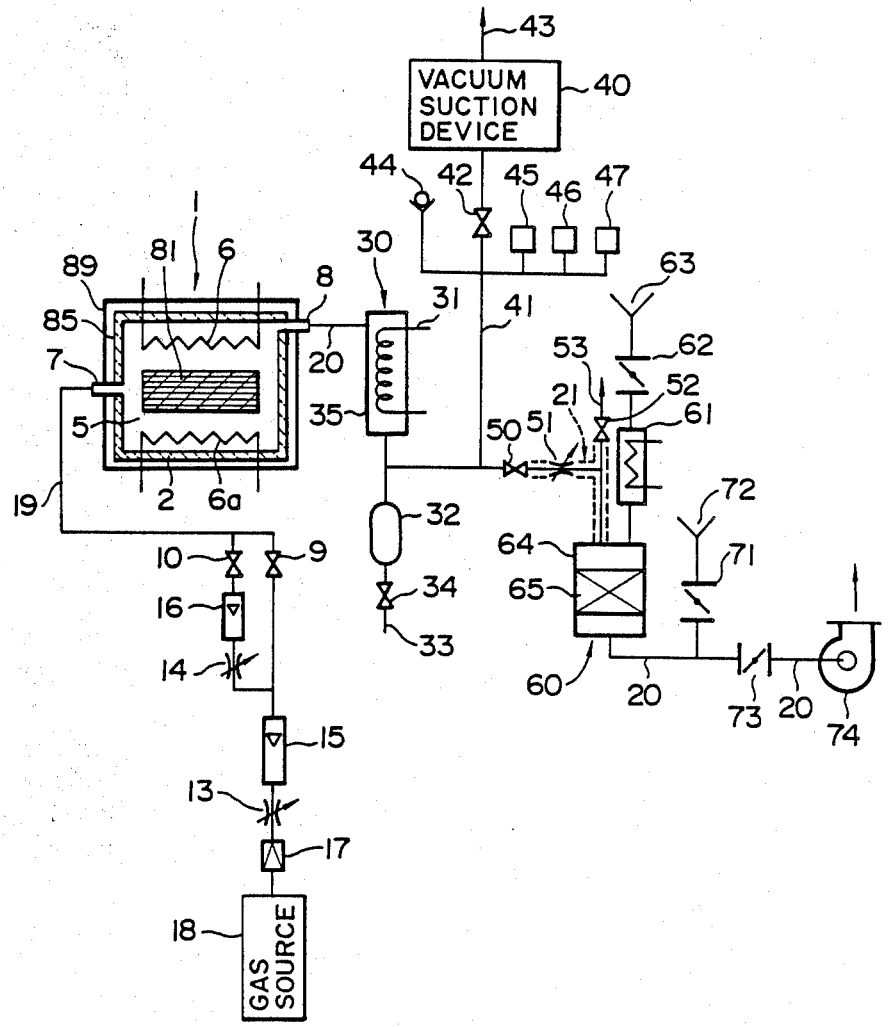
FIGS. 5 to 7 are system diagrams of the entire heat treatment system utilizing the heat treatment apparatus according to the present invention.
Figure 6:
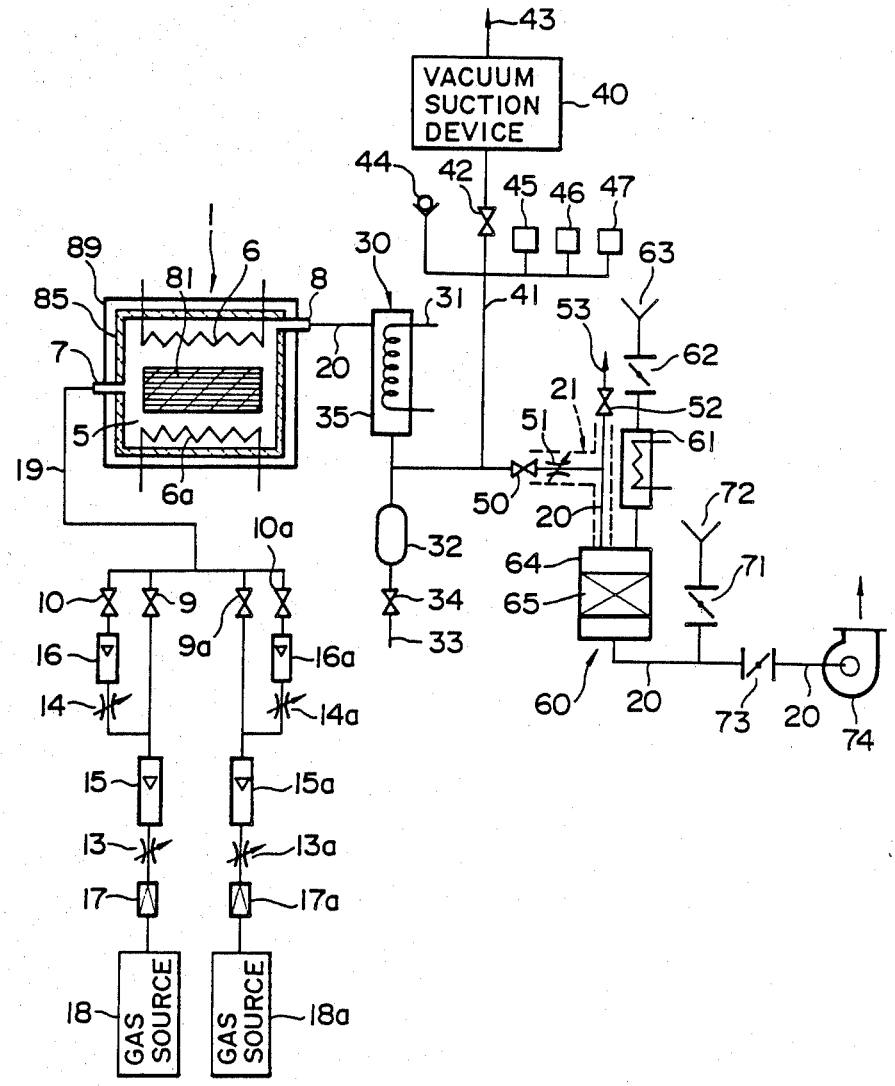

FIGS. 5 and 6 are system diagrams showing the total structure of heat treatment systems, each using a calcining furnace according to the present invention.

In FIG. 5, a calcining furnace 1 to apply heat treatment to workpieces 81 which contain heat decomposition substances essentially comprises the heat treatment chamber 5 enclosed with heat insulating walls 2, which are fixed in the chamber outer walls 85, and graphite heaters 6. The treatment chamber is equipped with an atmospheric air supply port 7 to receive gas from non-oxidizing gas source 18 through a gas supply pipe 19, valves 9 and 10, throttle valves 13 and 14, a pressure reducing valve 17 and flow meters 15 and 16. The treatment chamber 5 is also equipped with an exhaust port 8, and an exhaust pipe 20 is connected to the exhaust port. On the exhaust pipe 20, are arranged in order, starting from the treatment chamber 5, an exhaust gas cooling device 30, a heat resisting vacuum-proof valve 50, an exhaust gas incineration device 60 having an air induct port 63, and, at times, an exhaust fan 74. A vacuum suction device 40 with an exhaust port 43 is connected through valve 42 to the exhaust pipe between the treatment chamber and the heat resisting vacuum-proof valve 50, and the heat resisting vacuum-proof valve 50 can separate the area of combustible gas atmosphere generaged by thermal decomposition of workpieces 81, i.e. the area left of the heat resisting vacuum-proof valve shown in FIG. 5, from the oxidizing atmosphere area, i.e. the area right of the heat resisting vacuum-proof valve shown in FIG. 5. As for the heat resisting vacuum-proof valve 50, heat resisting vacuum-proof on-off valves currently sold on the market, such as vacuum-proof valves of the electro-solenoid type or the compressed air type, etc. can be used.

What is important for safe operation of an apparatus of the above constitution is to maintain the pressure of the combustible gas atmosphere at a higher level than that of the oxidizing atmosphere, at least under the conditions where the workpieces 81 generate combustible gas through thermal decomposition. For this purpose, it is necessary either to install an exhaust fan 74 in a position following the exhaust gas incineration device 60 as shown in FIG. 5, thereby reducing the pressure of the oxidizing gas atmosphere, or to increase the pressure of the non-oxidizing gas supplied to the calcining furnace 1.

With the above constitution, it is possible to prevent the oxidizing atmosphere from flowing backwords into the combustible gas atmosphere, so that it will not produce a mixed gas exceeding the explosion limit or cause oxidization damage to the workpieces. Even if the pressure balance should reach a point where the danger of counterflow is a possibility, the generation of an explosive mixed gases can be prevented by closing the heat resisting vacuum-proof valve 50, using some detection device such as a pressure switch.

As it is necessary, as described later, to replace beforehand the combustible gas atmosphere with a non-oxidizing gas, operations of a vacuum suction device 40 and valves 9, 10, 42 and 50 should be selected depending on the required purity of the atmospheric gas. Generally, a vacuum pump is used for the vacuum suction device 40 and materials with the necessary vacuum resistibility are used for the valves 9, 10, 42 and 50 and inner walls of chamber structural material 85. As the gas conducted out of the exhaust port 8 is of high temperature, however, it is difficult to use ordinary materials of high vacuum-proof for the above valves. For this reason an exhaust gas cooling device 30 consisting of a cooling chamber 35 equipped with a cooling pipe 31 and of a drain recovery vessel 32 is installed in the middle of the exhaust pipe 20, which connects the exhaust port 8 and the connecting pipe 41 to the vacuum suction device 40. By the exhaust gas cooling device 30, the exhaust gas flowing to the heat resisting vacuum-proof valve 50 is cooled, thereby maintaining vacuum-proof potential and ensuring heat resistance of the heat resisting vacuum-proof valve. At the same time it is preferable to use materials of strong structure with enough vacuum potential and sealing ability to form the inner walls of the chamber structural material 85 and the valves 9, 20 and 42. Drain produced from a part of the substance generated by thermal decomposition condensed in the exhaust pipe 20 may be accumulated in the aforementioned vessel 32 located at the bottom of the cooler and be recovered from the drain recovery port 33 by opening valve 34.

In case the substance resulting from heat decomposition with a high boiling point in the thermal decomposition gas should stick and accumulate as a solid or condense to a cool part of the piping to conduct the thermal decompostion gas from the exhaust port 8 to the exhaust gas incineration device 60, this may be prevented by using a temperature maintaining heater 21 composed of an electric heater or other heater. Such a heater is positioned so as to cover the exhaust pipe 20 from the heat resisting vacuum-proof valve 50 to the exhaust gas incineration device 60 and the throttle valve 51. It is important to maintain the heating or keep the temperature by the heater 21 at not lower than the boiling point of the substances generated by thermal decomposition, normally at 200° C.

The exhaust gas incineration device 60 may be either a direct combustion type or a catalytic type, and the example in FIG. 5 is of the catalytic type. The air necessary for combustion is conducted from the air conduction port 63, the flow amount of the air is adjusted by the damper 62, and the air is pre-heated by the air heater 61 and then led to the incineration chamber 64. In the chamber 64 the air is mixed with the substances generated by thermal decomposition containing exhaust gases, which has been introduced from the exhaust pipe 20, and is incinerated by the catalyst 65. The air heater 61 serves to achieve the activating temperature for the catalyst 65.

The incinerated exhaust gas is led through the exhaust pipe 20, the flow amount is adjusted by the damper 73, and the adjusted gas flow is discharged into the outside air either as it is produced or by means of the exhaust fan 74. In the case of latter, if the temperature of the exhaust gas is too high for the heat resistency of the exhaust fan 74, the temperature of the exhaust gas should be decreased by means of water-cooling or drawing in the outside air from the air intake port 72 through the damper 71 as shown in FIG. 5.

In case the density of the substances generated by thermal decomposition contained in the exhaust gas is low enough for the exhaust gas to be discharged into the outside air without treatment, it may be discharged directly out through the discharge port 53 by opening the direct exhaust valve 52. With this method, it is not necessary to keep operating the exhaust gas incineration equipment all the time, thereby improving energy efficiency.

FIG. 6 is a system diagram showing the total structure of a further preferable heat treatment system using a calcining furnace according to the present invention.

According to the composition illustrated in FIG. 5, the atmospheric gas supply port 7 installed at the treatment chamber 5 supplies only one kind of gas. In most cases $N_2$ gas is used as the non-oxidizing gas in the temperature range of approximately 2000°–2500° C. from the cost point of view, and when the gas is used at higher temperatures, other kinds of gas, such as Ar and He, are usually used instead of $N_2$, because reaction between $N_2$ and graphite heaters or graphite group heat insulating materials in a calcining furnace becomes violent.

In FIG. 6 the apparatus is so structured that the non-oxidizing gas supply port 7 is connected to separate gas sources 18 and **18*a*, each through valves 9, 10, 9*a* and 10*a* respectively. Of course, a plurality of gas supply ports 7, one for each gas source, may be installed instead of single gas supply port as in the above example. The other parts of the configuration are the same as those already explained with respect to FIGS. 1 to 5. For example it is assumed that the gas source 18 is $N_2$ and the gas source 18*a* is Ar. The explanation is given as follows, taking up an example case where the workpieces are to be calcined at 2800° C. Firstly, after evaluating the atmosphere in the treatment chamber 5 by means of the vacuum suction device 40 until the inside of the chamber reaches a specified degree of vacuum, the atmosphere in the treatment chamber 5 is replaced with $N_2$ by opening the valve 9. Secondly, the heat resisting vacuum-proof valve 50 is opened to let $N_2$ flow and then, while $N_2$ is flowing, the temperature in the chamber is increased, operating at the same time the exhaust gas incineration device whenever necessary. It is preferred that the temperature of the heaters is preset by means of a programed thermo-regulator. When the temperature in the chamber has increased to a specified level, 2000° C. for instance, $N_2$ is supplied from valve 10 instead of valve 9, which is closed at that moment, and at the same time valve 9*a* is opened to supply Ar. With $N_2$ and Ar flowing in, the atmosphere in the treatment chamber is gradually changed from $N_2$ to a $N_2$/Ar mixed gas. Then, after calcining the workpieces 81 in the atmosphere of $N_2$/Ar mixed gas at 2800° C., the temperature is decreased. When the temperature is reduced to 2000° C., the atmosphere in the chamber is again changed to $N_2$ and cooled while the gas is flowing. Exchange between $N_2$ and $N_2$/Ar mixed gas during an increase or decrease of temperature may also be done with the vacuum suction device 40** in the same manner as at the beginning of the process. A plurality of non-oxidizing gases may be supplied by means of a simultaneous switchover as described above or, as the case may be, by supplying only Ar into the atmosphere consisting of $N_2$ until the density of $N_2$ reaches a specified low level.

Further, according to a system shown in FIG. 6, each of the valves 9, 10, 9*a* and 10*a*, the throttle valves 13, 14, 13a and 14, the reducing valves 17 and 17*a* and the flow meters 15, 16, 15*a* and 16*a* and the gas sources 18 and 18*a* are arranged in parallel.

Next, the control system of the present heat treatment systems shown in FIGS. 5 and 6 is hereinafter explained, taking up the example of FIG. 5.

The temperature control of the calcining furnace 1 calls for increasing or reducing the temperature of the heaters 6 with a specified raising/lowering profile of temperature by means of the programed thermo-regulator, detecting signals for the temperature sensor in the treatment chamber 5, such as, for example, a thermoelectric couple or a radiation heat thermometer. The pressure of a non-oxidizing gas atmosphere area, including the treatment chamber 5, is controlled by pressure switches 45 and 46 to detect the lower and upper limits of treatment pressure and by a valve 9 for a large supply and a valve 10 for a small supply at the non-oxidizing gas supply port. It is desirable to detect, with the upper limit switch 46 and the lower limit switch 45, whether the treatment pressure is within the specified range or not and according to this detection, to adjust the throttle valves 13, 14 and 51, in order to supply non-oxidizing gas normally from valve 10 for supply of a small amount, and only when the treatment pressure reaches the lower limit, to open the valve 9 for supply of the gas of a large amount.

In case the treatment pressure is lowered below the set limit of the lower limit switch 45 due to some problem, for instance suspension of the gas supply, the system calls for holding or halting operation of the heaters 6 due to signals from the treatment pressure lower limit alarm switch 47, which is set lower than that of the gas pressure lower limit switch 45 and higher than the pressure of the oxidizing atmosphere, and at the same time closing the heat resisting vacuum-proof valve 50 in order to prevent the counter flow of gas from the exhaust gas incinerating device 60 into the combustible gas atmosphere area.

When the treatment pressure is returned to the set pressure of the lower limit alarm switch 47, normal operation is resumed. If the treatment pressure rises above the set limit of the upper limit switch due to some problem, the pressure in the combustible gas atmosphere area can be maintained lower than the maximum resistance pressure by releasing gas from the relief valve 44. It is desirable to use an electo-solenoid type or compressed air operation type valve for the above valves 9, 10, 42 and 50.

In case it is predictable whether thermal decomposition gas will start to be generated at a specified temperature and will cease to be generated at another specified temperature, operation of the exhaust gas incinerating device 60 may be, preferably, started when the gas temperature has reached a certain specified temperature, by detecting the signal from the thermoregulator of heater 6 or 6*a* in the heat treatment chamber, and stopped when generation of the thermal decomposition gas has ceased. Of course it is better to maintain control of the temperature of the preheater 61 for supplying air during the operation, while detecting the gas temperature at the exit of the catalytic layers 65 so that the specified activating temperature of the catalyst is maintained.

The structure of the control system hereinabove explained is also applicable to the other embodiment illustrated in FIG. 6.

Figure 7:
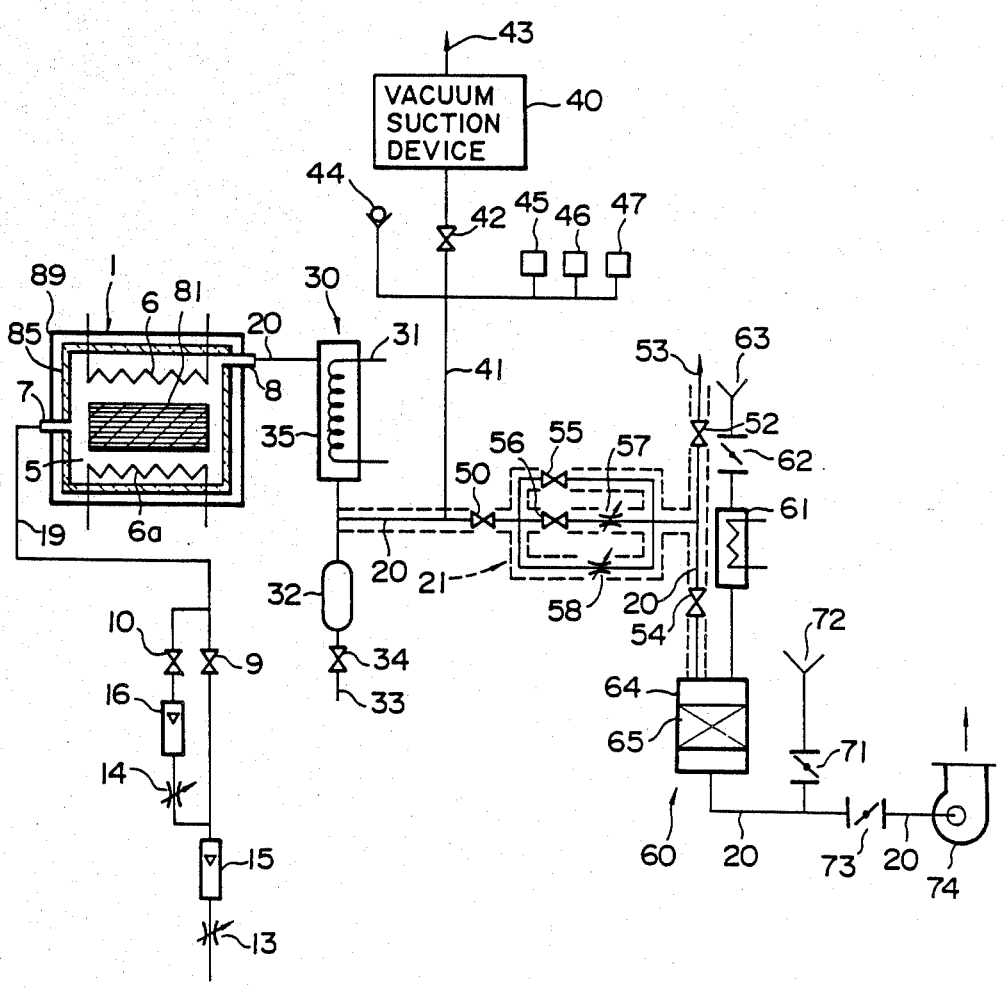

FIG. 7 is a schematic system diagram of equipment of a further preferable embodiment of the heat treatment apparatus according to the present invention.

In the structures shown in FIGS. 5 and 6, as the flow volume at the gas exhaust side is fixedly determined, corresponding to the operation of the throttle valve 51, there is a fear, when only a small amount of non-oxidizing gas is being supplied from the small amount supply valve 10, that the discharging speed cannot cope with the extreme heat expansion of the gas in the chamber nor the fast generating speed of the thermal decomposition gas caused by a sudden rise in temperature.

In the system shown in FIG. 7, the exhaust pipe 20 is forked at the position immediately following the heat resisting vacuum-proof valve 50, so as to consist of a pipe having a regular exhaust valve 56 and a throttle valve 57, another pipe with a small volume exhaust throttle valve 58 and one with a bypass exhaust valve 55. Further, the exhaust pipe immediately before the exhaust gas incinerating device 60 is equipped with a heat resisting valve 54, and a direct exhaust port 53 is connected, through a heat resisting valve 52 which functions as a direct exhaust valve, to the exhaust pipe 20 between the heat resisting valve 54 and the heat resisting vacuum-proof valve 50.

with the structure as above, the range of discharging speed of the exhaust gas is widened so that the treatment pressure is prevented from rising to more than the pressure resistency of the non-oxidizing gas atmosphere area. On the other hand, in cases where the treatment temperature is not high enough for substances generated by thermal decomposition to be generated or the amount of thermal decomposition gas is extremely marginal from the environmental point of view, or when the temperature is being lowered, it is preferable for the purpose of saving gas and energy that the treatment pressure be kept not much higher than the natural atmospheric pressure and that only the throttle valve 58 for small amount of exhuast be opened on the gas exhaust side and to discharge gas directly through the direct exhaust valve 52.

Each valve in the above structure (system) may be either a manual or an auto valve operated by signals, but the latter is preferable for purposes of operation.

Explanations will be given hereinafter as to the effect of the heat treatment apparatus 1 according to the present invention, which is illustrated in FIGS. 1 to 4, in comparison with conventional methods, taking up as an example the case where the workpieces were in the shape of a plate, whose maximum size was 1100 mm long×1100 mm wide, stacked to a total height of 300–500 mm and calcined at 2700° C. with the aim of achieving a life span of graphite heaters and heat insulating materials of not less than 20 batches and 40 batches, respectively, in order to improve operation capacity.

The life span of the graphite heaters referred to hereinabove means the number of batches processed up to the moment when the electrical resistance value, which can be found by calculating backwards from the amount of voltage and current applied to the heaters, has increased to 20% over the initial value, due to sublimation and/or reaction of the graphite heaters to atmospheric gas.

The life span of the graphite heat insulating material referred to hereinabove means the number of batches processed up to the moment when the amount of power consumed to maintain a temperature of 2700° C. has increased to 30% over its initial value, due to the heat insulating material's transformation into tar, caused at high temperature, by the same reasons as described above, and by the inflow of thermal decomposition substances.

EXAMPLE 1

As shown in FIG. 1, in order to treat workpieces with the size as described as above, the calcining furnace 1 according to the present invention has a treatment chamber 5 with inner dimensions of 1750 mm×1450 mm×1000 mm, which is formed with heat insulating walls 2 consisting of 125 mm thick rigid graphite felt 3 and 2 mm thick graphite foil 4 with 1.12 g/cm$^3$ bulk density and with an emissivity of about 0.67 at 2000° C. 36 graphite pipe heaters of 50 mm diameter and 500 mm length are arranged in the treatment chamber 5, under conditions where Ah/Ai=0.25 and Ar/Ah=3.3. In order to heat the workpieces 81 with the present calcining furnace 1 in the $N_2$ atmosphere to the temperature of 2700° C., the temperature being measured with the radiation thermometer 88, it is necessary to have the temperature of the graphite heaters 6 in the range of 2750°-2780° C., the temperature of which is measured by another thermometer at another temperature measuring port. As a result, the life span of the graphite heaters 6 is extended to 20-23 batches for heat treatment which calls for maintaining the temperature of the workpieces at 2700° C. for one hour. The life span of graphite foil 4 is extended to 43 batches and the life span of the rigid graphite felt is extended longer than that of the graphite foil.

EXAMPLE 2

In the above example, by configuring the heat insulating walls 2 as shown in FIG. 4. i.e. the graphite foil 4 to be configured as a paraboloid with its foci at the graphite heaters 6, the set temperature of the graphite heaters 6 is lowered to 2730°-2750° C. and the life span of the graphite heaters 6 utilizing the same heat treatment as described in the above example is extended to 25-30 batches.

EXAMPLE 3

As a different example from the above, as shown in FIG. 2, the calcining furnace 1 has a treatment chamber 5 with inner dimensions of 1600 mm×1500 mm×750 mm, which is formed with heat insulating walls 2 consisting of 250 mm thick rigid graphite felt 3; and 0.5 mm thick glassy carbon sheet 4 with 1.47 g/cm$^3$ bulk density which serves as the surfaces of the inner walls which face each other, specifically the ceiling and the floor of the treatment chamber. The glassy carbon sheet is attached to the chamber outer wall 85, with the rigid graphite felt sandwiched between the glassy carbon sheet and wall 85, by means of graphite nuts and bolts. 18 graphite pipe heaters of 60 mm diameter and 850 mm length are arranged in the treatment chamber 5, under conditions where Ah/Ai=0.30 and Ar/Ah=1.20. In order to apply the same heat treatment as that in the above examples to the workpieces 81 with the calcining furnace 1 structured as above, it is necessary to have the temperature of the graphite heaters 6 in the range of 2750°-2800° C., and the life span of the graphite heaters 6 is 19-21 batches.

EXAMPLE 4

In the above Example 3, the heat insulating walls 2 are structured with the glassy carbon also attached to the inner surfaces of the other pairs of walls which faced each other, under condition where Ah/Ai=0.30 and Ar/Ah=2.6. The same heat treatment as that in the aforementioned example is applied utilizing the calcining furnace 1 structured as above, with the temperature of the graphite heaters 6 set in the range of 2730°-2780° C., resulting in the life span of the graphite heaters 6 being 22-25 batches.

COMPARISON 1

In the above example 1, the calcining furnace is structured according to the conventional method, with the heat insulating walls 2 consisting of only rigid graphite felt 3, without graphite foil 4, and 24 graphite pipe heaters, which served as the graphite heaters 6, of 30 mm in diameter and 500 mm in length arranged as shown in FIG. 1, and the heat treatment is carried out under conditions of Ah/Ai=0.099 and Ar/Ah=0. In this comparison, in order to perform heat treatment identical to the aforementioned examples, it is necessary to set the temperature of the graphite heaters 6 to not less than 2850° C. and the life span of the heaters is 5 batches in average. The life span of the rigid graphite felt 3 is less than 10 batches.

COMPARISON 2

In the above Comparison 1, although the set temperature of the graphite heaters 6 can be lowered to 2780°-2850° C. by restructuring the calcining furnace 1, changing the graphite heaters 6 to 36 graphite pipe heaters of 50 mm in diameter and 500 mm in length (Ah/Ai=0.246 and Ar/Ah=0), the life span of the heaters 6 under the same condition as above is less than 10 batches. The life span of the rigid graphite felt is also short, i.e. only 10-15 batches.

The above examples 1 to 4 and the comparisons 1 and 2 are summarized as below in the form of a table.

| | | | | Life span* | |
|---|---|---|---|---|---|
| | Structure | Ah/Ai | Ar/Ah | Graphite heaters | Heat insulating material** |
| Example-1 | FIG. 1 | 0.25 | 3.3 | 20-23 | 43 or more |
| Example-2 | FIG. 4 | 0.25 | 3.3 | 25-30 | 50 or more |
| Example-3 | FIG. 2 | 0.30 | 1.2 | 19-21 | 30 or more |
| Example-4 | FIG. 2 (Glassy carbon covering the whole surface) | 0.30 | 2.6 | 22-25 | 45 or more |
| Comparison-1 | FIG. 1 (no graphite foil) | 0.099 | 0 | 5 | less than 10 |
| Comparison-2 | FIG. 1 (no graphite | 0.246 | 0 | less than 10 | 10-15 |

-continued

| Structure | Ah/Ai | Ar/Ah | Life span* Graphite heaters | Life span* Heat insulating material** |
|---|---|---|---|---|
| foil) | | | | |

Note:
*Shown as number of batches for maintaining 2700° C. for 1 hour in the $N_2$ atmosphere.
**Life span of rigid graphite felt A heat treatment apparatus according to the present invention is effective not only as a heat treatment furnace utilized at high temperatures of more than 2500° C., to produce c/c composite, graphite materials, etc. for electrode base materials for fuel cells and so on, but also for other purposes of heat treatment at high temperatures. For example, it is effective as a calcining furnace to produce carbon fibers or graphite fibers, or, a carbon felt or a graphite felt, and especially as a heat treatment apparatus to calcine, at a high temperature in a non-oxidizing atmosphere, workpieces in the shape of a wide sheet or block, containing thermal decomposition substances. It is needless to say that this apparatus is also effective as a heat treatment furnace for workpieces containing no substances generated by thermal decomposition and as a heat treatment apparatus to be used at temperatures lower than 2500° C.

As explained above, a heat treatment apparatus according to the present invention is structured so that; the relationship between the inner surface area of the heat insulating walls (Ai) and the outer surface of the graphite heater (Ah), Ah/Ai, is 0.1–0.4; at least a part of the surface facing the treatment chamber of the heat insulating walls is formed with graphite group material of not less than 0.3 g/cm$^3$ bulk density; and the relationship between the area of the surface of the walls consisting of the graphite group material (Ar) and the outer surface of the graphite heater (Ah) is set for Ar>Ah. Therefore, it has become possible to make the load on the heater necessary to obtain a specified treatment temperature less than that required by conventional apparatus so that abnormal generation of heat at some parts of the heater can be prevented and the temperature of the heater may also be set lower. As a result, the life span of the graphite heater can be extended and the energy efficiency improved. A heat treatment apparatus according to the present invention is most suitable to be used for heat treatment at high temperatures of more than 2500° C. and is capable of calcining workpieces in the shape of a wide sheet or block in a non-oxidizing atmosphere with high efficiency.

Because of graphite group material of high bulk density, the heat insulating material forming the heat insulating walls is resistant to deterioration caused by reaction to atmospheric gas or substances generated by thermal decomposition or by vaporization and also resistant to solidication of substances generated by thermal decomposition, and thus its life span will also be extended.

Furthermore, even when the graphite group material, such as graphite foil, etc. deteriorats, it will only be the graphite group material in question that has to be replaced. Thus maintenance problems and cost will largely be saved compared with the conventional apparatus, which require replacement of the whole heat insulating material.

Moreover, the above described effects will be intensified by forming a paraboloidal surface whose focal points are the graphite heaters with the abovementioned graphite group material.

Furthermore, when a plurality of gas supply sources, each of which supplies a different gas, are connected to the non-oxidizing gas supply port, it becomes possible to select the most suitable gas depending on changes in the conditions of treatment. As a result, it will become possible to further extend the life span of the graphite heater and the heat insulating material and to further reduce the operational costs of the system.

Although several preferred embodiments of the present invention have been described in detail, it will be appreciated by those skilled in the art that various modifications and alterations can be made to the particular embodiments shown without materially departing from the novel teachings and advantages of this invention. Accordingly, it is to be understood that all such modifications and alterations are included within the scope of the invention, provided they come within the scope of the appended claims and their equivalents.

What is claimed is:

1. A heat treatment apparatus for applying heat treatment to workpieces in a treatment chamber having a non-oxidizing atmosphere comprising:

heat insulating walls forming said treatment chamber and comprising a heat insulating material, with at least a part of the surface facing said treatment chamber of said heat insulating walls consisting of a graphite group material of bulk density of not less than 0.3 g/cm$^3$;

a graphite heater disposed in said treatment chamber, the ratio of the outer surface area of said graphite heater (Ah) to the area of the surface facing said treatment chamber of said heat insulating walls (Ai), Ah/Ai, being 0.1–0.4, and the relationship between the area of the surface of wall made of said graphite group material of bulk density of not less than 0.3 g/cm$^3$ (Ar) and the outer surface area of said graphite heater (Ah) being Ar>Ah;

an atmospheric gas supply port for supplying gas in order to make said non-oxidizing atmosphere in said treatment chamber; and an exhaust port for discharging gas from said treatment chamber.

2. The apparatus of claim 1, wherein the emissivity at 2000° C. of said graphite group material is not more than 0.8.

3. The apparatus of claim 1, wherein the heat insulating material which forms said heat insulating walls is rigid graphite felt which is divided along its thickness into a plurality of layers.

4. The apparatus of claim 3, wherein the surfaces of said plural layers of rigid graphite felt are formed by graphite group material of not less than 0.3 g/cm$^3$ of bulk density.

5. The apparatus of claim 1, wherein said heat insulating walls consist of plural pairs of walls facing each other and said graphite heater is disposed facing at least one pair of said pairs of walls.

6. The apparatus of claim 5, wherein a pair of said graphite heaters are arranged facing one pair of said pairs of walls which face each other and the surfaces of the other pairs of walls are formed by graphite group material of not less than 0.3 g/cm$^3$ of bulk density.

7. The apparatus of claim 5, wherein the surface of heat insulating walls facing said graphite heater are formed by graphite group material of not less than 0.3 g/cm$^3$ of bulk density.

8. The apparatus of claim 1, wherein the surfaces of the heat insulating walls formed by said graphite group material of not less than 0.3 g/cm$^3$ of bulk density are facing said graphite heater, and said surfaces of the heat insulating walls, which face said graphite heater, form paraboloids whose focal points are the graphite heater.

9. The apparatus of claim 1, wherein said treatment chamber is structured in a vacuum-proof vessel, and a vacuum suction device is connected to said exhaust port through an exhaust pipe.

10. The apparatus of claim 1, wherein an exhaust gas cooling device is connected to said exhaust port through an exhaust pipe.

11. The apparatus of claim 1, wherein an exhaust gas incineration device is connected to said exhaust port through an exhaust pipe.

12. The apparatus of claim 1, wherein said treatment chamber is structured in a vacuum-proof vessel, an exhaust gas cooling device is connected to said exhaust port through an exhaust pipe, and a vacuum suction device and an exhaust gas incineration device are connected to said exhaust gas cooling device through a forked exhaust pipe.

13. The apparatus of claim 12, wherein a heat resisting vacuum-proof valve is installed in the fork portion which leads to the exhaust gas incineration device, of said forked exhaust pipe.

14. The apparatus of claim 13, wherein a direct exhaust valve is installed in the exhaust pipe between said heat resisting vacuum-proof valve and the exhaust gas incineration device in order to directly discharge the inflowing exhaust gas into the outside air.

15. The apparatus of claim 13, wherein a heating means is installed on the exhaust pipe between said heat resisting vacuum-proof valve and the exhaust gas incineration device in order to heat exhaust gas.

16. The apparatus of claim 1, wherein a forked gas supply pipe is connected to said atmospheric gas supply port with each fork equipped with a valve.

17. The apparatus according to claim 1, comprising a plurality of said atmospheric gas supply ports, each of said ports being connected to a gas source via a valve.

* * * * *